US008689391B2

(12) United States Patent
Eisenhut et al.

(10) Patent No.: US 8,689,391 B2
(45) Date of Patent: Apr. 8, 2014

(54) MOP PRESS

(75) Inventors: Andreas Eisenhut, Leimen (DE); Markus Rueckheim, Griesheim (DE); Juergen Huckele, Birkenau (DE); Jens Deerberg, Essen (DE)

(73) Assignee: Carl Freudenberg KG, Weinheim (DE)

( * ) Notice: Subject to any disclaimer, the term of this patent is extended or adjusted under 35 U.S.C. 154(b) by 430 days.

(21) Appl. No.: 12/990,967

(22) PCT Filed: Apr. 24, 2009

(86) PCT No.: PCT/EP2009/002998

§ 371 (c)(1),
(2), (4) Date: Nov. 4, 2010

(87) PCT Pub. No.: WO2009/135594

PCT Pub. Date: Nov. 12, 2009

(65) Prior Publication Data

US 2011/0056043 A1 Mar. 10, 2011

(30) Foreign Application Priority Data

May 6, 2008 (DE) ..... 10 2008 022 364

(51) Int. Cl.
*A47L 13/14* (2006.01)

(52) U.S. Cl.
USPC ..... 15/261; 15/260

(58) Field of Classification Search
USPC ..... 15/260, 261
See application file for complete search history.

(56) References Cited

U.S. PATENT DOCUMENTS

| | | | | |
|---|---|---|---|---|
| 5,333,353 | A * | 8/1994 | Taylor | 15/264 |
| 5,720,073 | A | 2/1998 | Kamada | |
| 6,006,397 | A * | 12/1999 | Williams et al. | 15/261 |
| 6,283,170 | B1 * | 9/2001 | Robinson | 141/1 |
| 7,540,063 | B2 * | 6/2009 | Petner | 15/260 |
| 2002/0120997 | A1 | 9/2002 | Alt | |
| 2005/0204503 | A1 | 9/2005 | Burns | |
| 2006/0085939 | A1 | 4/2006 | Petner | |
| 2006/0213021 | A1 | 9/2006 | Ducharme | |
| 2007/0084009 | A1 | 4/2007 | Bensussan | |
| 2008/0098548 | A1 * | 5/2008 | Deerberg et al. | 15/119.1 |

FOREIGN PATENT DOCUMENTS

| | | | |
|---|---|---|---|
| DE | 201 17 581 | U1 | 1/2002 |
| DE | 20 2006 015209 | U1 | 12/2006 |
| EP | 0734681 | A | 10/1996 |
| EP | 1 627 591 | A2 | 2/2006 |
| GB | 2 243 537 | A | 11/1991 |
| GB | 2 352 388 | A | 1/2001 |
| WO | WO 2005/117680 | A | 12/2005 |
| WO | WO 2007047456 | A2 | 4/2007 |

OTHER PUBLICATIONS

International Search Report for PCT/EP2009/002998.

* cited by examiner

*Primary Examiner* — Lee D Wilson
*Assistant Examiner* — Shantese McDonald
(74) *Attorney, Agent, or Firm* — Leydig, Voit & Mayer, Ltd.

(57) ABSTRACT

A mop press for wringing liquids out of a cleaning device includes a housing having a fastening mechanism; a lever-actuated wringing device disposed in the housing; and a support device disposed on the housing at a horizontal distance from the fastening mechanism.

8 Claims, 5 Drawing Sheets

MOP PRESS

CROSS REFERENCE TO PRIOR APPLICATIONS

This application is a U.S. National Phase application under 35 U.S.C. §371 of International Application No. PCT/EP2009/002998, filed Apr. 24, 2009, which claims benefit to German Application No. DE 10 2008 022 364.6, filed May 6, 2008. The International Application was published in German on Nov. 12, 2009 as WO 2009/135594 under PCT Article 21 (2).

FIELD

The invention relates to a mop press for wringing liquids out of a cleaning device, comprising a housing provided with a lever-actuated wringing device, said housing having a rear fastening mechanism.

BACKGROUND

Such a mop press is known from German utility model DE 20 2006 015 209 U1. The mop press serves to squeeze liquids out of a cleaning device, for example, a flat pad or a wet mop. The wringing device comprises a lever that is operatively connected to pressing plates via a shaft. Depending on the configuration, these pressing plates can move in different directions and can also be guided by a connecting link so as to follow a curved path. The pressing plates move against the cleaning device and press the textile part of the cleaning device against a counter-surface, for example, a perforated wringing basket. Such mop presses are usually used commercially. The mop press is affixed either to a mop bucket or to a cleaning trolley. For this purpose, the mop press has a rear fastening mechanism that can be, for example, a hook-shaped projection that forms a U-shaped recess that engages with the bucket or the cleaning trolley in order to affix the mop press. Here, the force that can be applied via the lever onto the wringing device can be limited by the fastening mechanism of the mop press and its counter-piece, for example, by the back wall of the bucket. With conventional designs of the fastening mechanism, the forces and torques generated during the pressing are absorbed in that a first, horizontally positioned counter-piece, for example, an upper tube or the upper edge of the bucket, engages with the U-shaped recess on the press, while a second counter-piece, for example, a lower tube or the surface of the rear wall of the bucket, supports the press vertically below the rear wall of the bucket at a typical distance of approximately 100 mm. If an excessive force if applied via the lever, the mop press can become detached from the fastening mechanism.

SUMMARY OF THE INVENTION

An aspect of the present invention provides mop press that is held securely and sturdily on a mop bucket or on a cleaning trolley, even when high forces are exerted.

In an embodiment, a support device is provided on the housing and it is at a horizontal distance from the fastening mechanism. Here, the support device is at a greater distance from the fastening mechanism than in the case of the familiar vertical arrangement. In the configuration according to the invention, this distance is more than 150 mm, as a result of which the torque generated by the pressing procedure is reduced to smaller bearing forces. Part of the force applied to the wringing device is dissipated via the support device. Since the support device is horizontally at a distance from the fastening mechanism, the mop press is supported at several points so that the mop press can be affixed to a mop bucket or to a cleaning trolley very firmly. Via the lever, high forces can be applied to the wringing device and these forces are reliably transmitted via the fastening mechanism and the support device, thereby improving the handling and the wringing performance. The support device can also be offset vertically, but it is essential for the support device to be at a horizontal distance from the fastening mechanism.

The fastening mechanism can consist of a hook-shaped projection. As a result, the mop press can be affixed especially easily onto a mop bucket or a cleaning trolley, and also removed again. All that is necessary is to hang the mop press in place.

The housing can comprise two side panels between which the wringing device is arranged. The side panels close off the mop press towards the outside and cover parts of the wringing device or accommodate parts of the wringing device, for example, a connecting link or a gear arrangement.

Each side panel can have a fastening mechanism on the rear. Here, the fastening mechanism can be shaped onto the side panels and can be manufactured together with them. Consequently, the fastening mechanism can be integrated especially easily into the mop press.

The fastening mechanism can be integrated into the wringing device. Here, the load that is applied via the lever directly onto the wringing device is dissipated without any detours.

The housing can have at least one projection that extends laterally, that protrudes beyond the housing and that forms the support device. This projection can likewise be integrated into the side panel and can be shaped onto it. However, the projection can also be a separate component. Since the projection is arranged on the side opposite from the fastening mechanism, the result is a sturdy support of the torques due to the large support width, along with easy production and compact dimensions.

A crossbeam can be arranged on the housing on the side opposite from the fastening mechanism, said crossbeam projecting laterally beyond the housing and forming the support device. The crossbeam can be a separate component or it can be made of a single material together with a component of the mop press. The crossbeam can have a rectangular cross section and can be configured to be especially sturdy, so that a secure support of the mop press is ensured.

The side panels can have a projection, and they form the support device. Here, the support device is made of a single material in one piece with the side panel, as a result of which it is especially easy to manufacture.

The projection can extend from the front to the back of the side panel. In this embodiment, the support is uniform along the side panel, resulting in a uniform load on the mop bucker or cleaning trolley.

The support device can be arranged on the wringing device. Here, the load that is applied via the lever directly onto the wringing device can be dissipated directly without any detours. The fastening mechanism, which is affixed to the side panel at the rear, is then the only force transmission means that is arranged in the side panel, so that the side panel only has to be configured commensurately in this area. Other areas of the side panels are then subject to small loads and can be configured with thinner walls. It is also conceivable for the fastening mechanism to be integrated into the wringing device. Then, the support is effectuated directly and immediately on the wringing device.

BRIEF DESCRIPTION OF THE DRAWINGS

A number of embodiments of the mop press according to the invention are explained in greater depth below with reference to the figures. Each of the figures schematically show the following.

DETAILED DESCRIPTION

Figure 1:
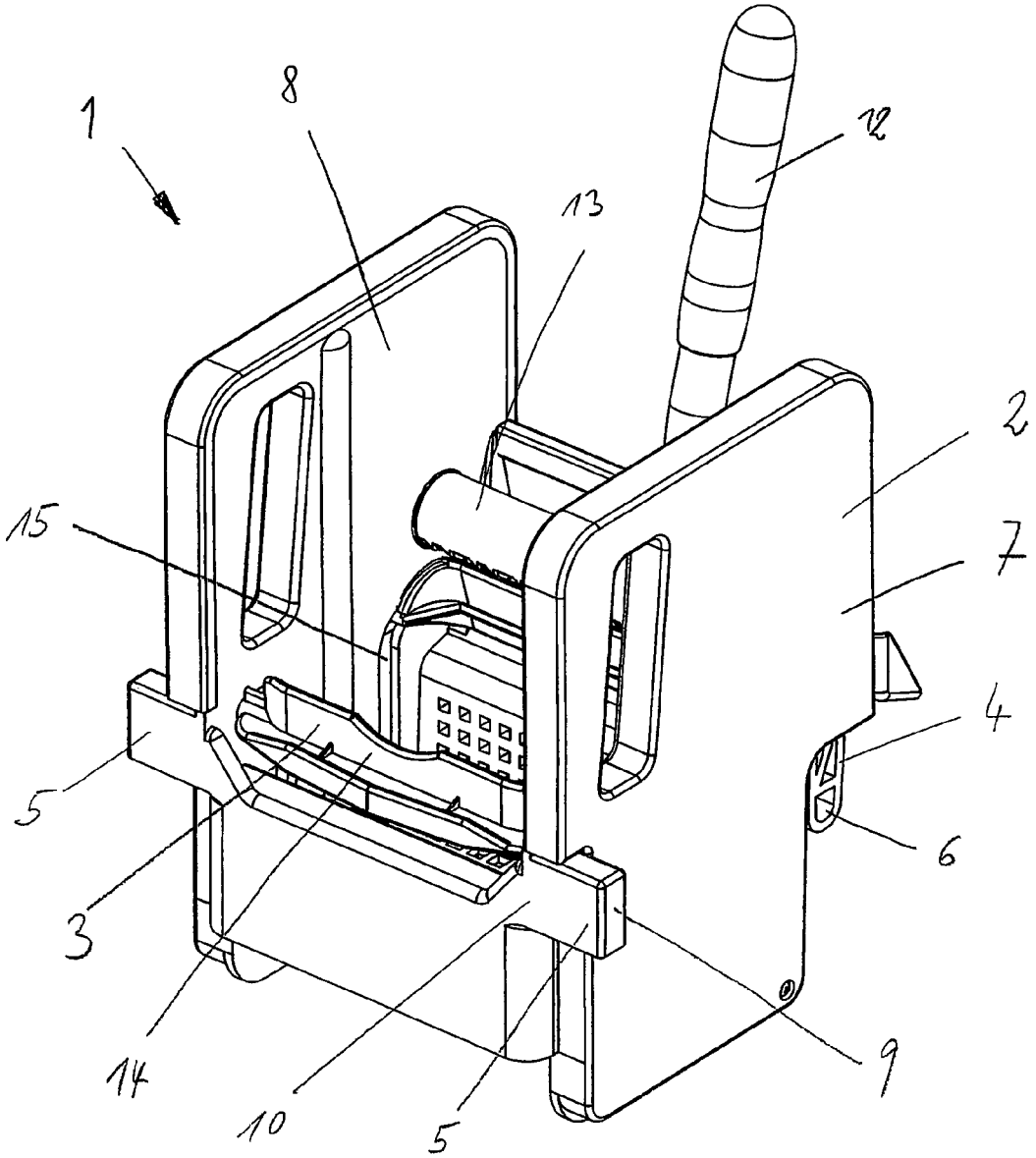
FIG. 1—a mop press with a crossbeam.

FIG. 1 shows a mop press 1 for wringing liquids out of a cleaning device, comprising a housing 2 consisting essentially of two side panels 7, 8 at a distance from each other, between which a lever-actuated wringing device 3 is arranged. The wringing device 3 comprises a lever 12 that opens up into a shaft 13, whereby the shaft 13 is supported in the side panels 7, 8. Within the side panels 7, 8, there is a gear arrangement via which the shaft 13 is connected to the pressing bars 14. These pressing bars 14 are guided in a connecting link 15 and, as a result, follow a curved path. In the housing 2, there is a rear fastening mechanism 4 for affixing the mop press to a mop bucket 16 or to a cleaning trolley 17. The fastening mechanism 4 consists of a hook-shaped projection 6 that is affixed directly to the wringing device 3. For stiffening purposes, the projection 6 is provided with ribs. There is such a projection 6 on each side, in the immediate vicinity of the side panel 7, 8. A support device 5 is provided on the housing 2 and it is at a horizontal distance from the fastening mechanism 4. For this purpose, there is a projection 9 that extends laterally to both sides on the housing 2 on the side opposite from the fastening mechanism 4, said projection protruding beyond the housing 2 and forming the support device 5. In this embodiment, the projection 9 is formed by a crossbeam 10 that protrudes laterally beyond the housing 2. The crossbeam 10 is made of a single material in one piece with the wringing device 3, and it is an integral part thereof.

Figure 2:
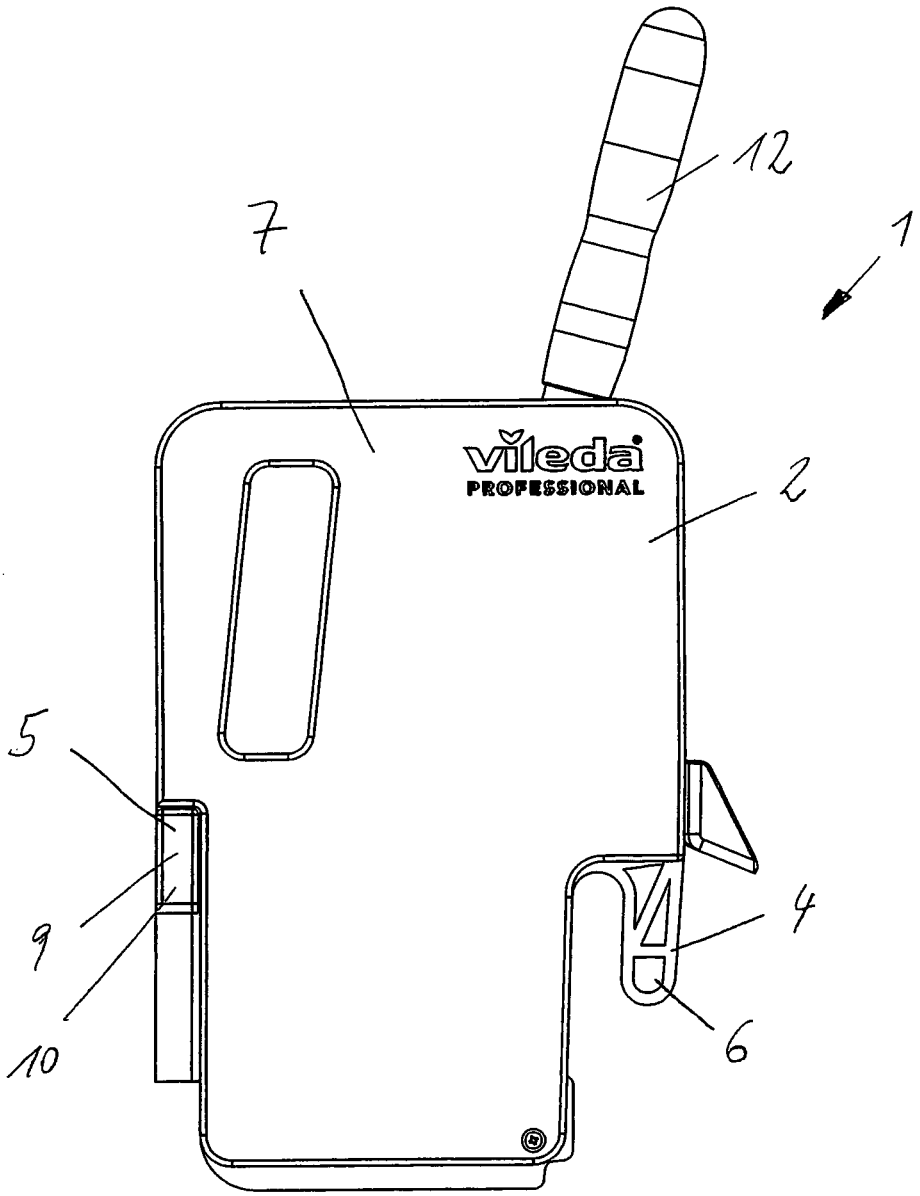
FIG. 2—a side view of the mop press according to FIG. 1.

FIG. 2 shows a side view of the mop press described in FIG. 1.

Figure 3:
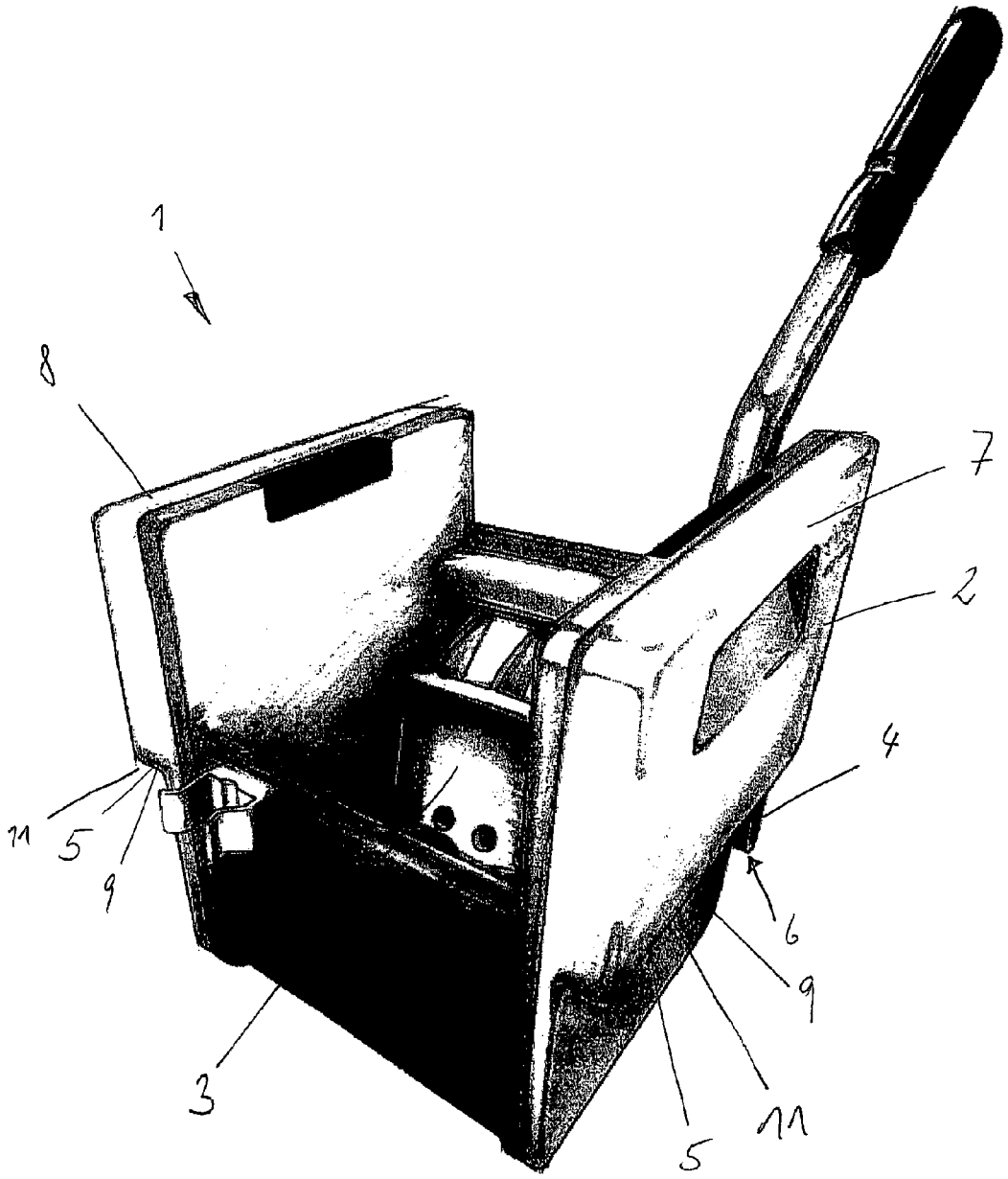
FIG. 3—a mop press with continuous projections integrated into the side panels.

FIG. 3 shows a mop press 1 for wringing liquids out of a cleaning device, comprising a housing 2 consisting essentially of two side panels 7, 8 at a distance from each other, between which a lever-actuated wringing device 3 is arranged. The wringing device 3 comprises a lever 12 that opens up into a shaft 13, whereby the shaft 13 is supported in the side panels 7, 8. Within the side panels 7, 8, there is a gear arrangement via which the shaft 13 is connected to the pressing bars 14. These pressing bars 14 are guided in a connecting link 15 and, as a result, follow a curved path. In the housing 2, there is a rear fastening mechanism 4 for affixing the mop press to a mop bucket 16 or to a cleaning trolley 17. The fastening mechanism 4 consists of a hook-shaped projection 6 that is affixed directly to the wringing device 3. For stiffening purposes, the projection 6 is provided with ribs. There is such a projection 6 on each side, in the immediate vicinity of the side panel 7, 8. A support device 5 is provided on the housing 2 and it is at a horizontal distance from the fastening mechanism 4. In this embodiment, the support device 5 is configured on the side panels 7, 8 which, for this purpose, each have a projection 11 extending horizontally from the front to the back of the side panels 7, 8.

Figure 4:
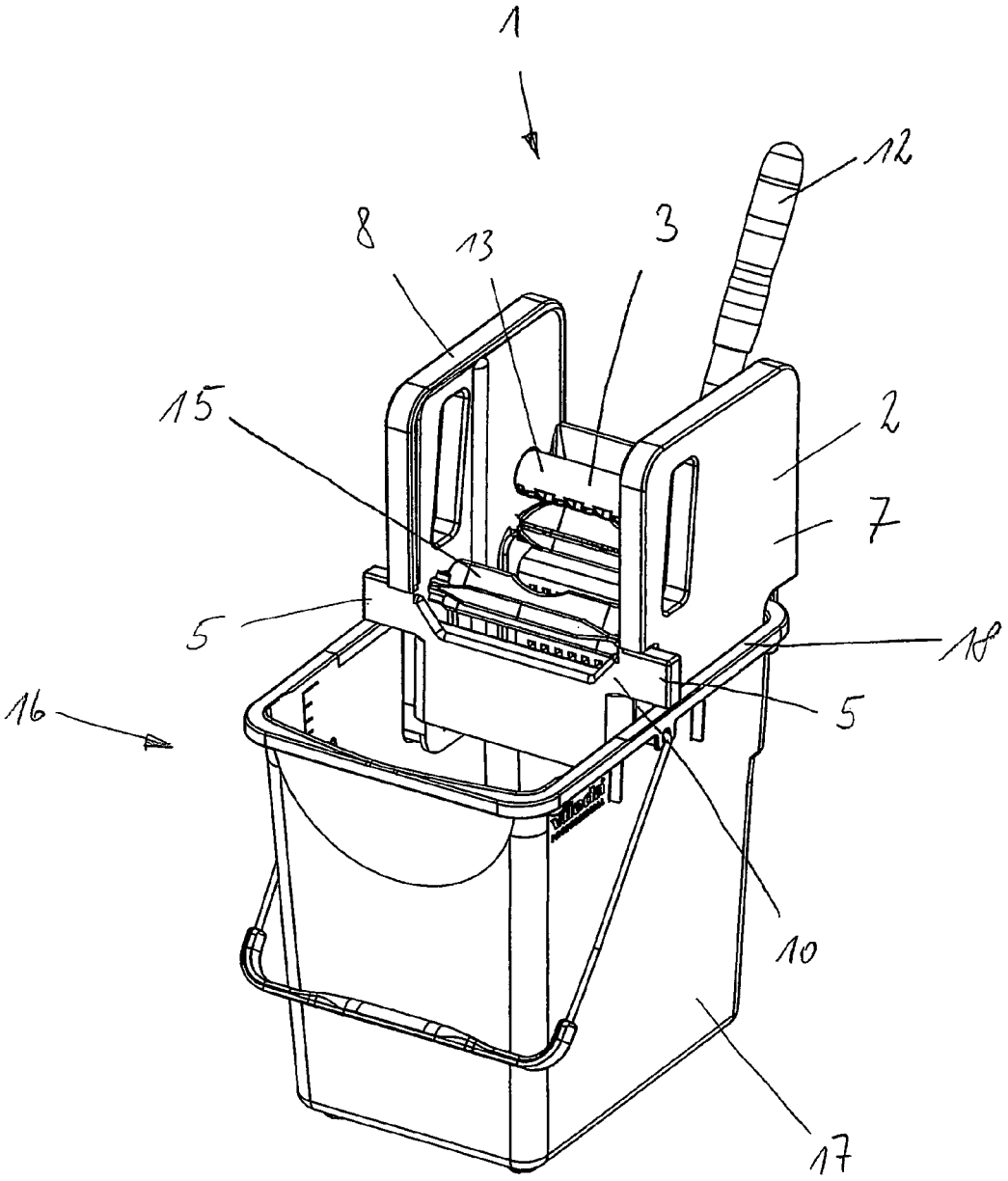
FIG. 4—a cleaning system consisting of a mop bucket and a mop press placed thereon.

FIG. 4 shows a cleaning system 16, comprising a mop bucket 17 with a mop press placed thereon, in the embodiment according to FIG. 1. It can be seen that the projection 6 of the fastening mechanism 4 extends around the rear edge of the mop bucket 17, and the support device 5, formed by the crossbeam 10, rests on the edge 18 of the mop bucket 17.

Figure 5:
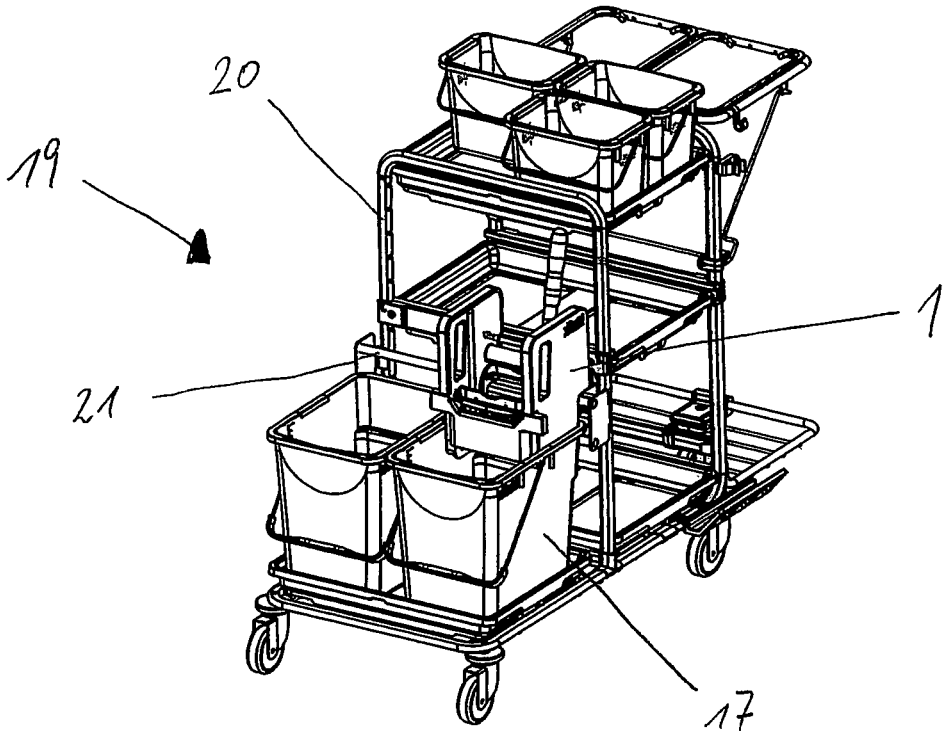
FIG. 5—another cleaning system consisting of a cleaning trolley with a mop press affixed thereto as well as a mop bucket that has been positioned underneath the mop press.

FIG. 5 shows another cleaning system 19, comprising a cleaning trolley 20 with a crossbeam onto which the mop press 1 is affixed. A mop bucket 17 is positioned on the cleaning trolley 20 below the mop press 1.

The invention claimed is:

1. A cleaning system, comprising:

a mop bucket;

a mop press configured for wringing liquids out of a cleaning device;

a housing including a fastening mechanism;

a lever-actuated wringing device disposed in the housing; and a support device disposed on the housing at a horizontal distance from the fastening mechanism, wherein the support device includes a crossbeam disposed on a side of the housing opposite the fastening mechanism and projecting laterally beyond the housing, wherein the fastening mechanism is integrated into the wringing device, wherein the crossbeam is configured such that the mop press can be placed upon the mop bucket, while the crossbeam rests upon an upper edge of the mop bucket, wherein the crossbeam does not extend in a direction of gravity through a plane of the upper edge of the mop bucket, wherein the crossbeam has a rectangular cross section having a first thickness and a second thickness, and wherein the first thickness is in the direction of gravity and is greater than the second thickness.

2. The mop press as recited in claim 1, wherein the fastening mechanism includes a hook-shaped projection.

3. The mop press as recited in claim 1, wherein the housing includes two side panels, and wherein the wringing device is disposed between the two side panels.

4. The mop press as recited in claim 3, wherein the fastening mechanism is disposed on one of the two side panels, and further comprising a further fastening mechanism disposed on another one of the two side panels.

5. The mop press as recited in claim 1, wherein the support device is disposed on the wringing device.

6. The mop press as recited in claim 1, wherein the support device is more than 150 mm from the fastening mechanism.

7. The mop press as recited in claim 1, wherein the crossbeam is a separate component.

8. The mop press as recited in claim 1, wherein the crossbeam is a single material together with a component of the mop press.

* * * * *